US006682030B2

(12) United States Patent
Santoro et al.

(10) Patent No.: US 6,682,030 B2
(45) Date of Patent: Jan. 27, 2004

(54) WORKSTATION WITH ADJUSTABLE HEIGHT FRAME

(75) Inventors: Ronald J. Santoro, Kalamazoo, MI (US); Richard A. Brinkman, Grand Rapids, MI (US)

(73) Assignee: Lista International Corporation, Holliston, MA (US)

( * ) Notice: Subject to any disclaimer, the term of this patent is extended or adjusted under 35 U.S.C. 154(b) by 0 days.

(21) Appl. No.: 10/092,857

(22) Filed: Mar. 7, 2002

(65) Prior Publication Data

US 2002/0145088 A1 Oct. 10, 2002

Related U.S. Application Data

(60) Provisional application No. 60/274,350, filed on Mar. 8, 2001.

(51) Int. Cl.[7] ..... F16M 11/26

(52) U.S. Cl. ..... 248/188.5; 108/147; 108/147.19

(58) Field of Search ..... 248/188.5, 188.2; 108/144.11, 147, 147.19, 10

(56) References Cited

U.S. PATENT DOCUMENTS

| | | | | | |
|---|---|---|---|---|---|
| 4,936,193 | A | * | 6/1990 | Stoll | 92/51 |
| 5,116,010 | A | * | 5/1992 | McMasters et al. | 248/309.1 |
| 5,423,502 | A | * | 6/1995 | Thomason et al. | 248/125.1 |
| 5,427,035 | A | | 6/1995 | Grahl | |
| 5,598,788 | A | * | 2/1997 | Jonker | 108/147 |
| 5,598,789 | A | * | 2/1997 | Jonker | 108/147 |
| 5,706,739 | A | * | 1/1998 | Shaheen et al. | 108/147 |
| 5,810,301 | A | * | 9/1998 | McGrath et al. | 248/118 |
| D399,079 | S | | 10/1998 | Hylen | |
| 5,941,182 | A | * | 8/1999 | Greene | 108/147 |
| 6,029,586 | A | * | 2/2000 | Schiavello | 108/147 |
| 6,484,648 | B1 | * | 11/2002 | Long | 108/147 |
| 6,510,803 | B1 | * | 1/2003 | Agee | 108/147 |

FOREIGN PATENT DOCUMENTS

| | | | | |
|---|---|---|---|---|
| DE | 19816306 A1 | * | 10/1999 | A47B/9/12 |
| DE | 10112940 A1 | * | 10/2002 | A47B/9/20 |
| GB | 2262030 A | * | 6/1993 | A47B/9/04 |

OTHER PUBLICATIONS

Aero–Motive Company—1999 Product Brochure "Ergomation" Products.

* cited by examiner

*Primary Examiner*—Korie Chan

(57) ABSTRACT

A height-adjustable workstation main frame includes a pair of telescoping, adjustable legs and a rigid yet efficient fixing frame carried by the upper portions of the legs to provide lateral stability, increased weight bearing capacity and functional flexibility. The same telescoping leg structure is adaptable to receive a motor drive, a manual crank lift or a manually adjusted mechanism for establishing the desired height of the table top. Fore and aft stability is increased by the shape and interengagement of the telescoping inner and outer leg weldments and the use of duplicate, laterally aligned bearing slide assemblies interconnecting the inner and outer leg weldments of each telescoping leg.

13 Claims, 14 Drawing Sheets

WORKSTATION WITH ADJUSTABLE HEIGHT FRAME

RELATED APPLICATION

This application claims the benefit of the filing date of co-pending U.S. Provisional Application No. 60/274,350, filed Mar. 8, 2001.

FIELD OF THE INVENTION

The present invention relates to workstations for industrial or commercial use. Workstations of this nature may be used in the electronic industries for assembling components or products, or in light manufacturing industries for assembling a wide range of mechanical products, as well as in other applications. More particularly, the present invention relates to improvements in the main frame (or "table frame") for such workstations.

BACKGROUND OF THE INVENTION

Workstations for use in manufacturing industries have long been known. Such workstations generally include left and right side upright structures called "legs" which are mounted on wheeled feet or bases for support and mobility and which may be adjusted in height to set the table top of the workstation at a desired height. The legs are connected together at their upper ends by a rear frame member called a fixing frame, and toward the user's position or "front" of the workstation, struts are carried by the top of the adjustable leg structures for supporting the tabletop or work surface on which the manufacturing or assembly are performed. The front edge of the table or support surface is supported by a stringer which is mounted at its sides respectively to the forward portions of the table top support struts.

As used herein, the "left" and "right" sides of a workstation are the left and right sides respectively from the standpoint of a worker at the workstation. The "front"of the workstation is adjacent to the worker, and the "back" of the workstation is remote from the worker when located in the normal working position.

It is desirable in workstations of this nature that the table top be adjustable in height. This is accomplished, in some cases, through the upright leg structures. However, the use of adjustable legs of the type used in the past have been accompanied by undesirable instability in the support legs, particularly at the higher elevations of adjustment. That is, as the prior art legs are extended for higher height adjustment, the portions of the legs which overlap becomes reduced, thereby reducing the ability of the extended leg to resist lateral forces, particularly forces in a fore and aft direction.

Some workstations have height adjusting mechanisms which are motor driven, and therefore more expensive. Others are manually adjustable as by hand crank, and therefore somewhat less expensive, and finally, some are completely manually adjustable (called "slide leg" adjusting mechanisms), which is the least expensive. In the past, providing the three different types of height adjustments has required the use of substantially different components and sub-assemblies in the adjustable leg structures of each type, thus adding costs for manufacturers desiring to offer all three versions to customers.

Moreover, the fixing frame, which is a structural support member that spans the distances between the tops of the legs, provides lateral support to the frame and load support for material or tools placed on or supported by the work surface. The fixing frame is an important structural component of the table frame since it supports any accessories or storage racks mounted to the table frame.

SUMMARY OF THE INVENTION

The adjustable leg of the present invention is symmetrical about a vertical transverse plane (i.e., extending side to side) so that the same structure may be a left or a right side leg. This is referred to as being "unhanded"—that is, being neither right-handed nor left-handed.

The leg assembly includes inner and outer legs which are received in sliding telescoping relation. The inner and outer legs each have a side panel and two end walls (front and rear) which are V-shaped when viewed from above. A pair of slide assemblies are incorporated into each leg assembly. The slide assemblies are laterally aligned in the fore-to-aft direction. The V-shaped end walls and the slide assemblies act to stabilize the main frame in the fore-to-aft direction; and the fixing frame stabilizes the main frame laterally and supports the load. The adjustable leg assembly of the present invention is adapted for a slide leg (manual) adjustment or it may be upgraded to a hand crank or to a motorized version using the same basic structure.

The shape of the improved fixing frame of the present invention is a box beam with upper and lower channels. The box beam is formed by fixing (as by welding) a large channel member to the vertical web of a formed metal main beam. The channels are open and extend horizontally and they are parallel to one another. The box beam adds structural support to carry vertical load, and the open channels serve as mounting tracks for upright supports, if desired. Access ports are provided in one side of the box beam for use as a chase or open duct for storage and routing of electrical cables and pneumatic hoses suppling electricity and pneumatic pressure to the workstation. The web of the main beam of the fixing frame is solid and acts as a modesty panel. In summary, the fixing frame acts as a slotted track for mounting components, a modesty panel and wire/hose duct.

Other features and advantages of the present invention will be apparent to person skilled in the art from the following detailed description of an illustrated embodiment accompanying by the attached drawing wherein identical reference numerals will refer to like parts in the various use.

DETAILED DESCRIPTION OF THE EXEMPLARY EMBODIMENTS

Figure 1:
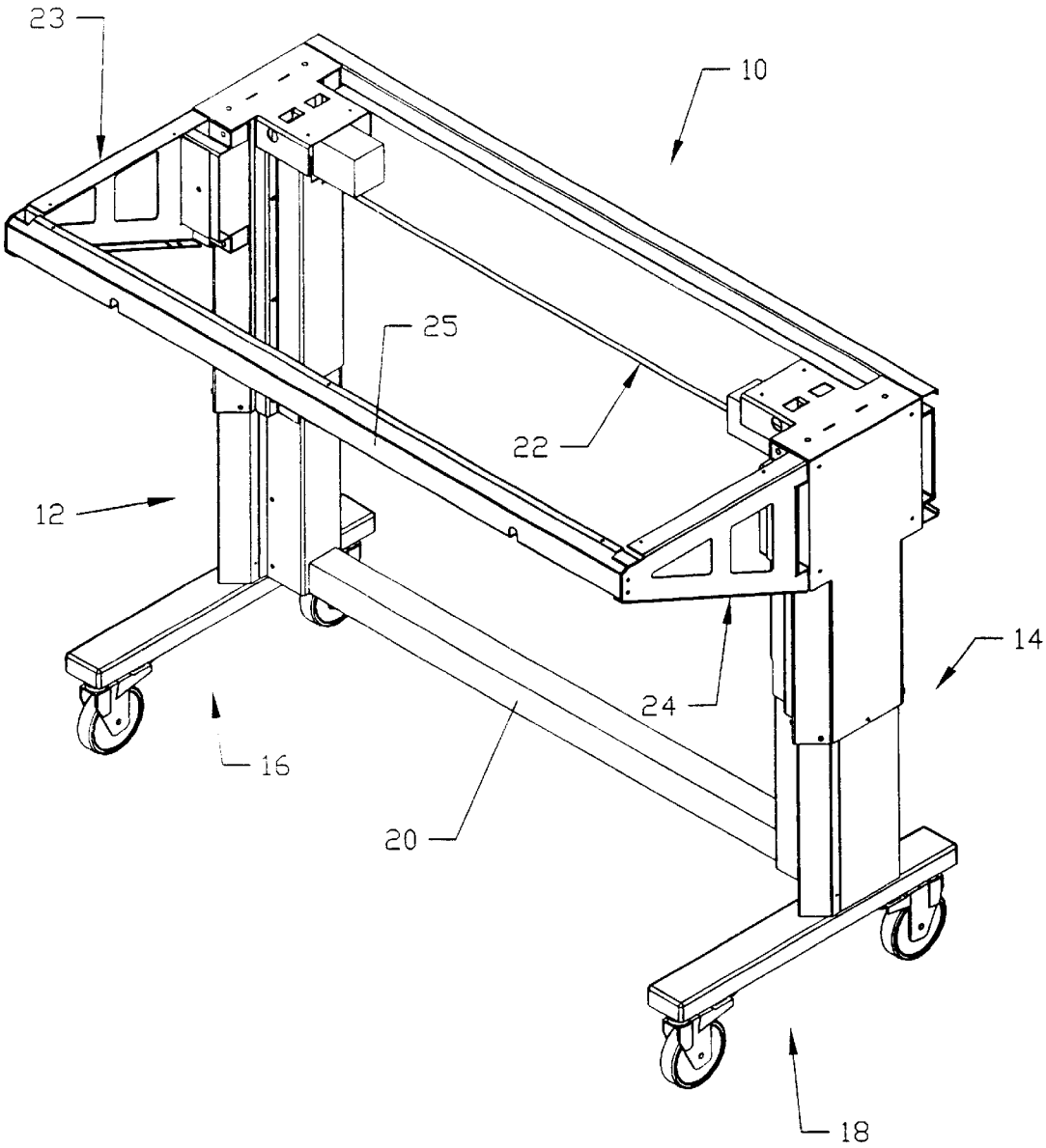
FIG. 1 is an upper, front, right side isometric view of a workstation main frame incorporating the present invention with a motor drive for height adjustment.

Turning first to FIG. 1, reference numeral 10 generally designated a height-adjustable main frame for a workstation. The main frame 10, as viewed from the front, includes a left leg assembly 12, a right leg assembly 14, a left side wheeled foot or base generally designated 16 for supporting the left leg assembly 12, a right wheeled foot or base 18 for supporting the right leg assembly 14, a lower stringer 20 interconnecting the lower portions (i.e., inner legs, as will be understood from further description below) of the left and right leg assemblies 12, 14, a rear fixing frame generally designated 22, connected at its sides to the upper portions of the left and right leg assemblies respectively, and left and right table top support struts, designated respectively 23, 24, the forward ends of which are interconnected by means of a horizontal deck tube 25.

Figure 2:
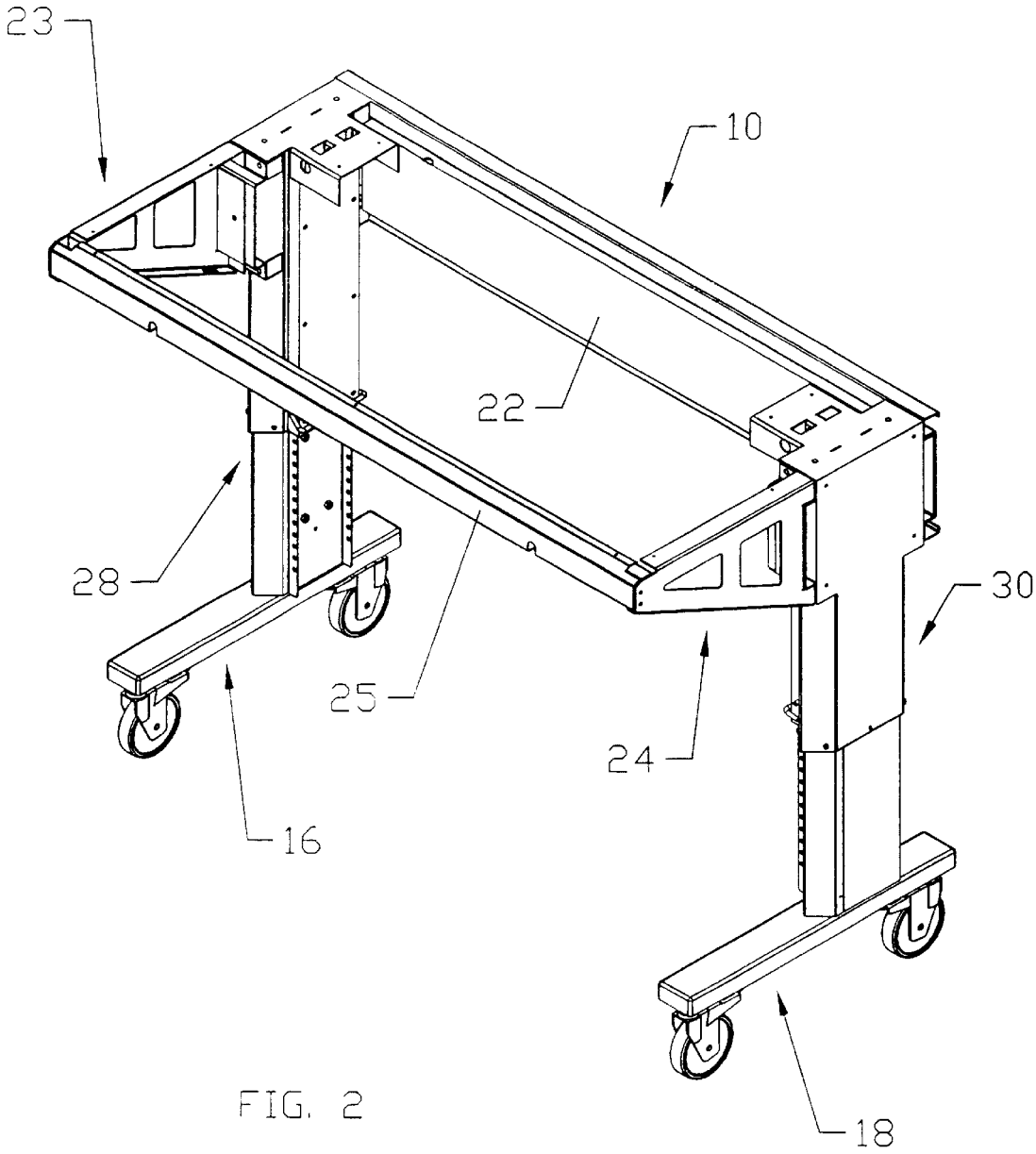
FIG. 2 is a view similar to FIG. 1 for a manual slide height adjustment mechanism.

As mentioned, the changes made to the workstation frame in upgrading the main frame from a manual slide adjustment (as seen in FIG. 2) to a hand crank mechanism or to an electric motor driven mechanism (FIG. 1) include minor modifications to the leg assemblies alone. Moreover, the leg assemblies are, as indicated above, unhanded so that the same leg assembly, whether a manual slide leg assembly, a hand crank leg assembly or a motor driven leg assembly are interchangeable left and right sides so that only one such leg assembly need be described in detail, with the changes noted for the upgrades mentioned. Persons skilled in the art will understand how the various upgrades or versions of the main frame are structured.

Turning then to FIG. 2, components or elements of the motor driven adjustable leg described in connection with FIG. 1 which are repeated in the manually adjusted slide version of FIG. 2 are identified with the same reference numerals and need not be repeated here. The primary differences are in the left and right telescoping legs which are designated respectively 28 and 30 in FIG. 2, and the omission of the lower stringer 20 which is not necessary in the slide leg version because, as will be further discussed below, the inner and outer legs are coupled together rigidly in that version, so the legs are better able to resist the kinds of torque loads experienced by moving the workstation over uneven or tiled floors.

As will be further described within, the telescoping, adjustable legs of the workstation version having a hand-crank assist for vertical adjustment are very similar to the adjustable legs with a motor driven version, and any differences will be described within, although, as indicated, they are minor.

Figure 3:
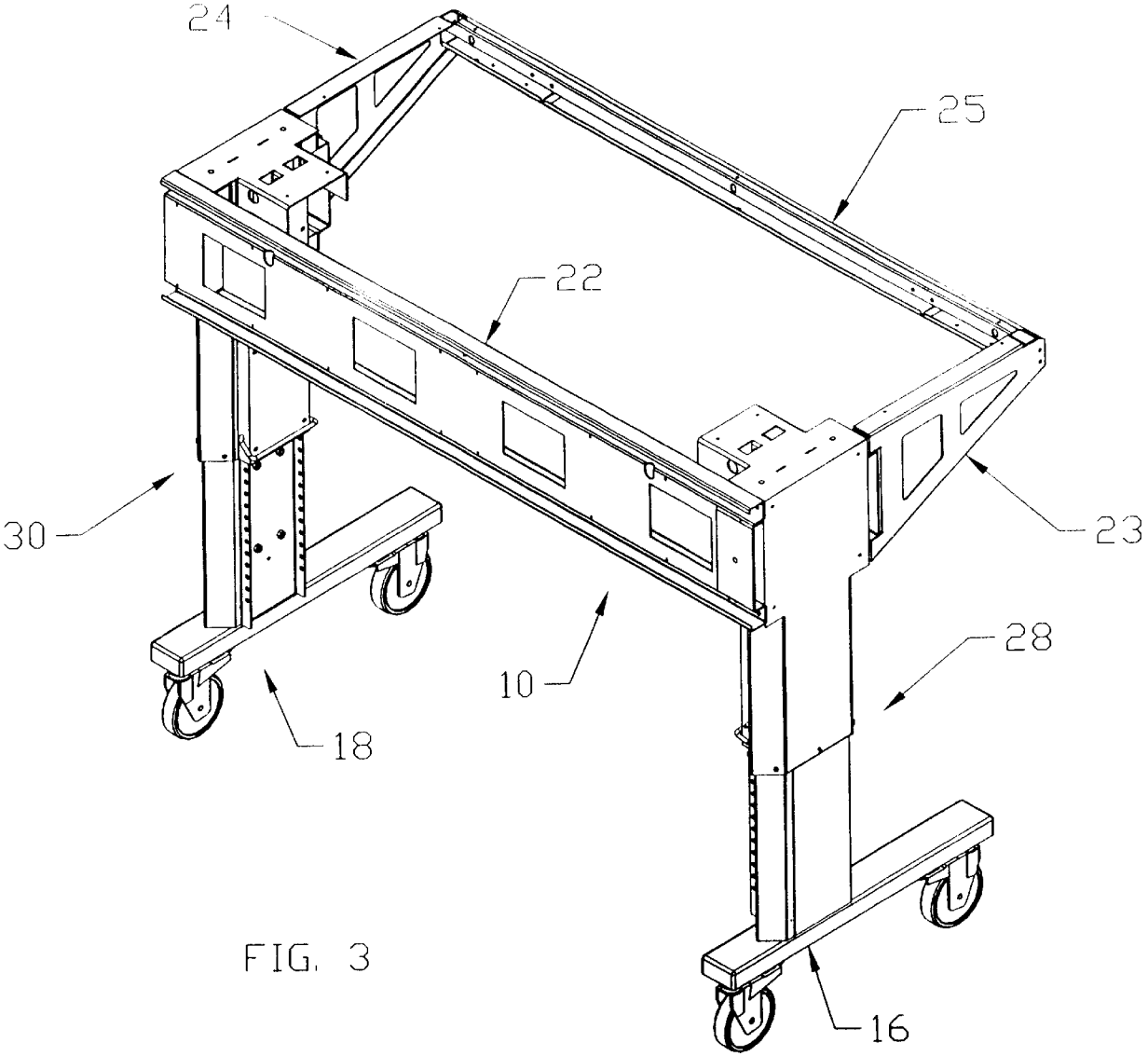
FIG. 3 is a upper, rear, left side isometric view of the workstation main frame of FIG. 2.
Figure 4:
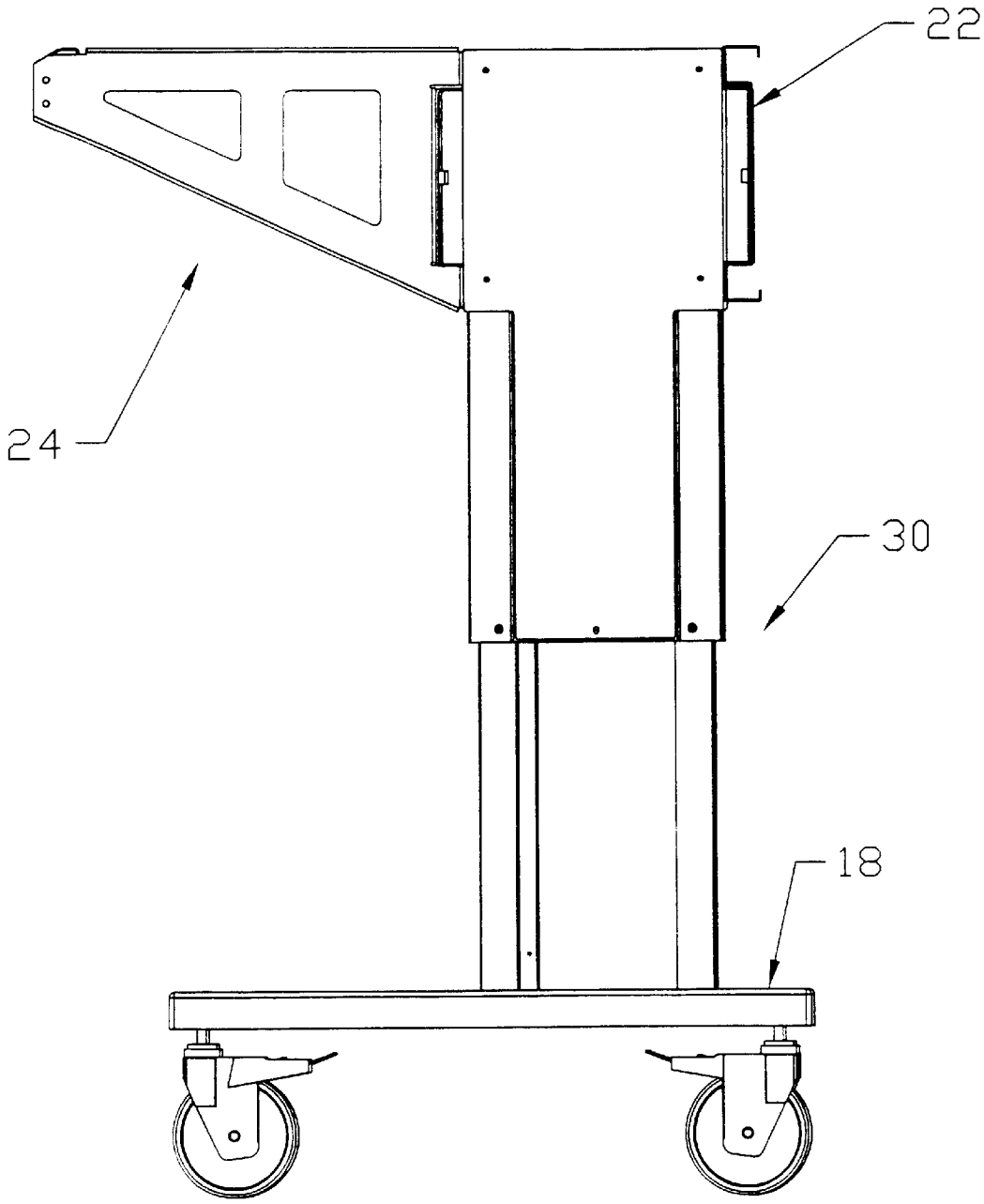
FIG. 4 is a right side elevation view of the workstation main frame of FIG. 2.

Turning now to FIG. 3, there is shown a rear perspective view of the manual slide leg version of the main frame 10 shown in FIG. 2. A side view of the main frame 10 as seen in FIG. 2 for the manually adjustable slide leg version is seen in FIG. 4.

Figure 5:
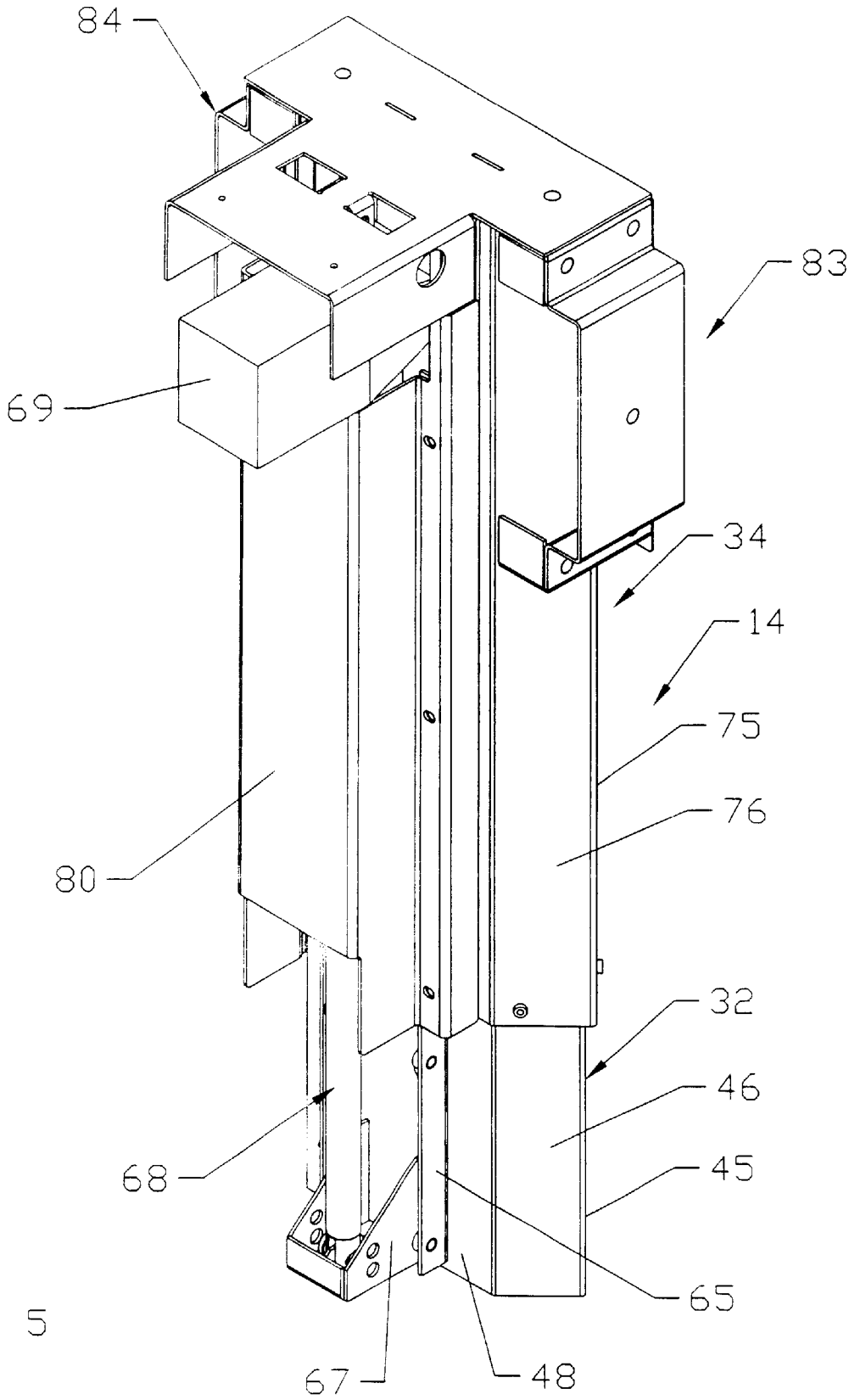
FIG. 5 is an isometric view of an adjustable leg assembly for the workstation for FIG. 1 adapted to a motor driven actuator.
Figure 6:
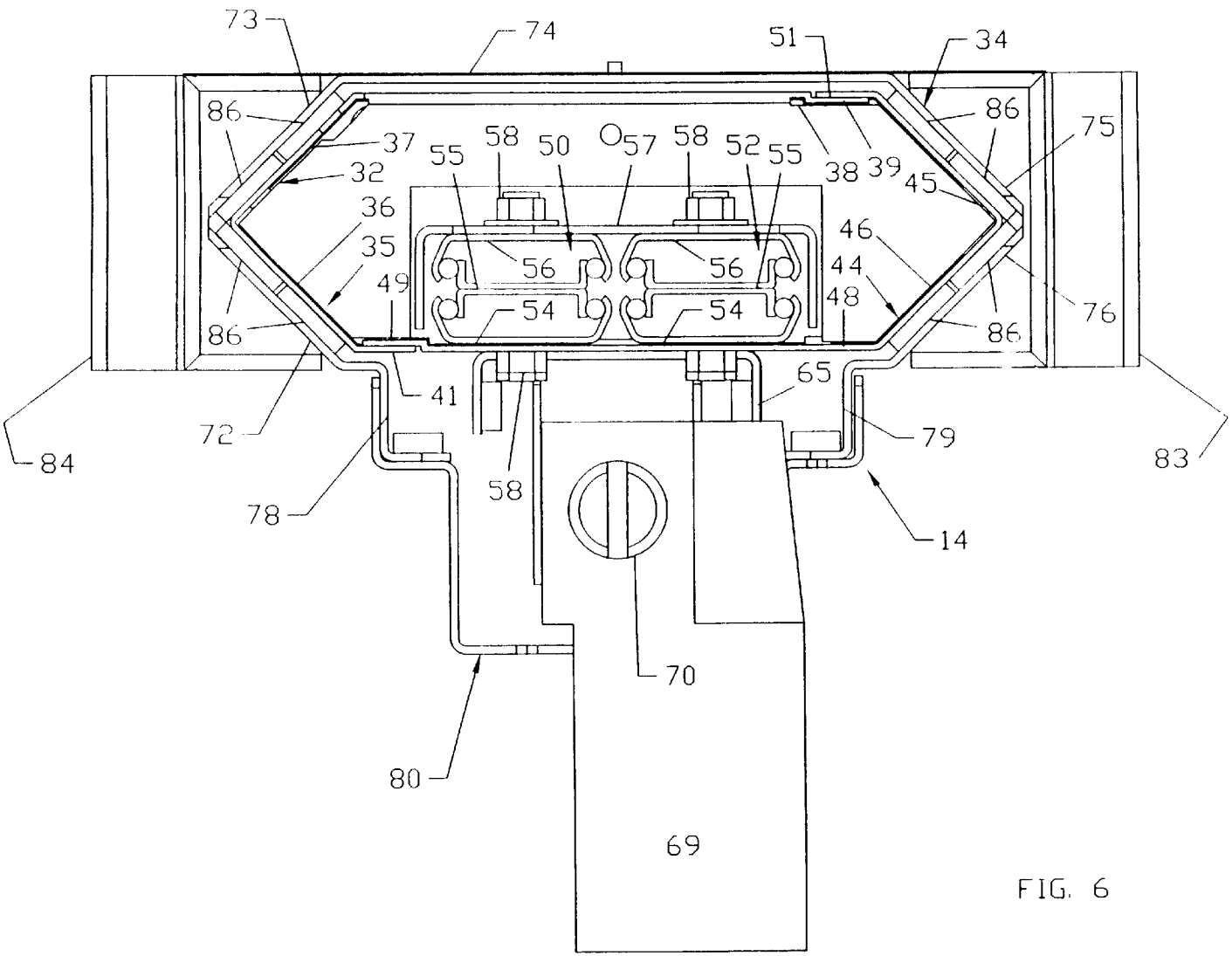
FIG. 6 is a plan view of the leg assembly of FIG. 5.

Turning now to FIGS. 5 and 6, there are shown, in FIG. 5, an isometric view of the motor driven adjustable leg 14 in FIG. 1, and FIG. 6 is a plan view of the telescoping leg 14. As mentioned, the telescoping leg 14 may be substantially the same in structure to telescoping leg 12 of FIG. 1. In the illustrated embodiment, the adjustable legs are shown mounted to wheeled feet or bases. Persons skilled in the art will appreciate that levelers or pads could equally well be used in place of the caster wheels shown.

Referring then to FIGS. 5 and 6, each telescoping leg 14 includes an inner leg generally designated 32 and an outer leg generally designated 34. The inner leg 32 is a weldment formed of sheet metal including two major components forming the outer perimeter of the inner leg. One component is designated 35 in FIG. 6, and it includes first and second inclined walls 36, 37 which are formed into a general V-shape. The point of the V, in the embodiment of FIG. 6, faces toward the rear of the table in use. The weldment component 35 also includes a sidewall 38, at the forward end of which there is provided a vertical marginal edge 39. Similarly, the distal or inside end of the component 35 includes a vertical marginal edge 41.

The second major component of the inner leg weldment includes a sheet metal component 44 which is complimentary in shape to the previously described component 35, including first and second end walls 45, 46 formed into a V-shape pointed toward the front of the table, a flat side wall 48, at the rear portion of which there is a marginal edge 49 which overlaps and engages the previously described marginal edge 41 of the weldment component 35. At the distal end of the sidewall 45, there is a marginal edge 51 which overlaps and engages the marginal edge 39 of the weldment component 35 of the inner leg. The marginal edges 39 and 51 are welded together, as are the marginal edges 41, 49 of the two components 35, 44, thereby forming a rigid, hollow inner leg weldment having front and rear sides which are V-shaped.

A pair of conventional slide mechanisms generally designated respectively 50 and 52 in FIG. 6 are operationally mounted between the inner leg 32 and the outer leg 34. Each of the slide mechanisms 50, 52 is similar in shape so that only one need be described further for a complete understanding of the invention. The slide mechanisms 50, 52 each include a first side member 54, a central member 55, and a second side member 56, all of which are elongated in a vertical direction. As is known in the art, each of the slide mechanisms includes rows of ball bearings between the respective side members and the center member so that the slides freely extend as shown partially in FIG. 14. The bearings are shown at 59 in FIG. 8, and are well known to those skilled in the art of drawer slides, for example.

Figure 14:
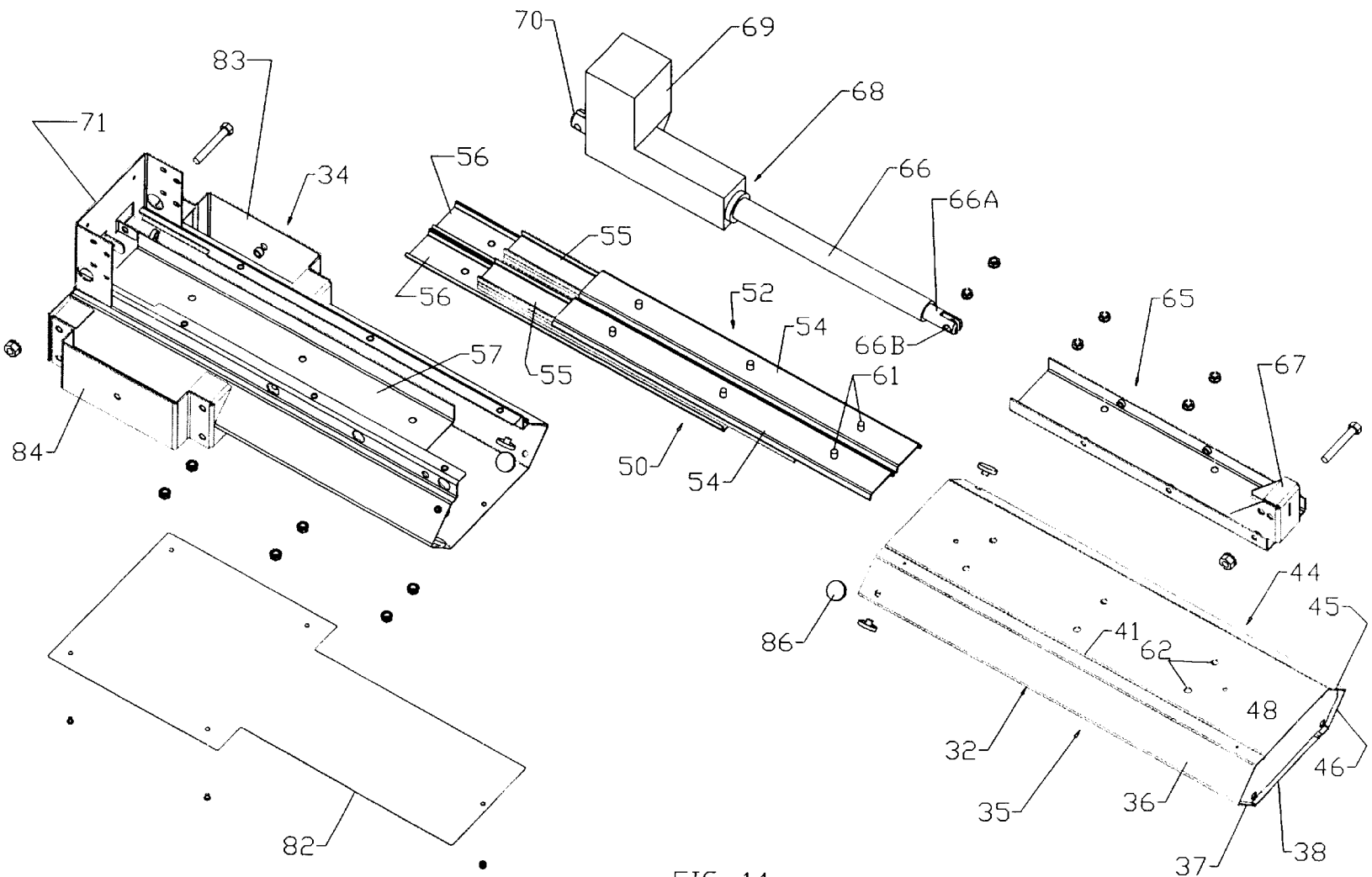
FIG. 14 is a perspective view of an adjustable leg assembly adapted for motor drive, with the major components in exploded relation, for the workstation of FIG. 1.

The two slide mechanisms 50, 52 as can be seen best in FIGS. 6 and 14, are arranged and aligned side-by-side in the fore-to-aft direction of the leg, and hence, the workstation. The adjacent side members 56 of the slide mechanisms 50, 52 are rigidly mounted to a channel member 57 by means of studs (welded to the sides of the slide members 56) and nuts and lock washers 58. The channel member 57 thus secures one member 56 of each slide rigidly together, and, as will be further described below, rigidly connects those slide members to the outer telescoping leg 34.

The corresponding first side members 54 of the slide mechanisms 50, 52 are similarly mounted (that is, by weld studs and nuts 58) to the flat side 48 of the inner telescoping leg 32. As seen in FIG. 14, the weld studs designated 61 fit through corresponding apertures 62 in the side 48 of the inner telescoping leg weldment 44.

The weld studs 61 also pass through corresponding aligned apertures in a channel member generally designated 65 which is rigidly mounted to the inner leg weldment, and carries the motorized linear actuator generally designated 68 in FIG. 14. The linear actuator 68, as known in the art, includes an internal shaft 66A which is provided with an acme thread on which there is fitted a correspondingly threaded nut. The shaft 66A is journaled in housing 68 and driven in rotation by the motor. The nut is fixed to a lower tubular housing 66. The bottom of shaft 66A connected by clevis 66B to a bracket 67 on the channel 65 so that as the shaft is turned in one direction, the linear actuator extends and when the motor is reversed, the rotary motion of the shaft is likewise reversed and the linear actuator contracts. Motor housing 69 is provided with a mounting extension 70 which is mounted to a top plate 71 of the outer upper telescoping leg weldment 34.

Turning now to FIG. 6 and the remainder of the outer leg 34, it is shaped to conform to the exterior of the inner leg 35. The outer leg 34 includes a single piece of sheet metal which is formed at the back or rear of the work station into first and second inclined end walls 72, 73 which form a V-shape conforming to the shape previously described in connection with V-shaped walls 36, 37 of the inner leg 32. The outer leg 34 then is formed into a flat outer sidewall 74 and first and second inclined end walls 75, 76. The inclined walls 75, 76 form a V-shape conforming to the shape of the previously described walls 45, 46 of the inner leg 32. The end walls of the inner leg nest with the end walls of the outer leg. The distal edges of the sidewalls 72, 76 of the outer leg 34 are then formed into angled flanges designated respectively 78, 79 for receiving a cover generally designated 80 for housing the lower portion of the linear actuator 68 beneath the motor housing 69. An end panel seen at 82 in FIG. 14 is mounted to cover the outer side.

At the top of the height adjustable telescoping leg 14, there are welded a pair of mounting brackets designated respectively 83 and 84. The brackets 83, 84 are interchangeable and include members which conform to the V-shape of the associated end walls 72, 73 and 75, 76 of the outer leg 34. The inclusion of both brackets 83, 84 renders the adjustable telescoping leg to be unhanded and, when used as a right leg assembly, to employ the bracket 84 to mount the fixing frame 22. When used as a left leg frame, the bracket 83 (FIG. 5) is used to mount the fixing frame 22 to the left adjustable leg.

Referring now to FIG. 14 in particular, previously described channel 57 is located within the outer leg, The upper portion of channel 57 is welded to the underside of the cover 71 so that the channels 56 of the slides 50, 52 are integral, structural, load-bearing members of the outer leg because they are bolted to the channel 57.

The operation of the telescoping leg structure will now be apparent. Briefly, however, the slide assemblies 50, 52, which are located side-by-side and laterally aligned in the fore-to-aft direction of the table, permit the inner and outer leg structures to telescope freely. The outer surface of the inner leg weldment 32 and the inner surface of the outer leg 34 may be separated by friction reducing pads composed of a low friction material such as nylon, and placed between the nested, V-shaped end walls of the telescoping sections, as indicated by the pads designated 86 in FIG. 6. That is, the nylon friction-reducing pads 86 are located between the corresponding V-shaped end wall portions of the inner and outer leg assemblies and guide the outer leg assembly relative to the inner leg assembly as the two structures are telescoped. The channel 57 and side members 56 of the slide assemblies 50, 52 move with the outer leg assembly, whereas the side members 54 of the slide assemblies 50, 52 have their lower portions rigidly secured to the corresponding horizontal cross member 22 of the wheeled bases 16, 18 via channel 65.

Figure 7:
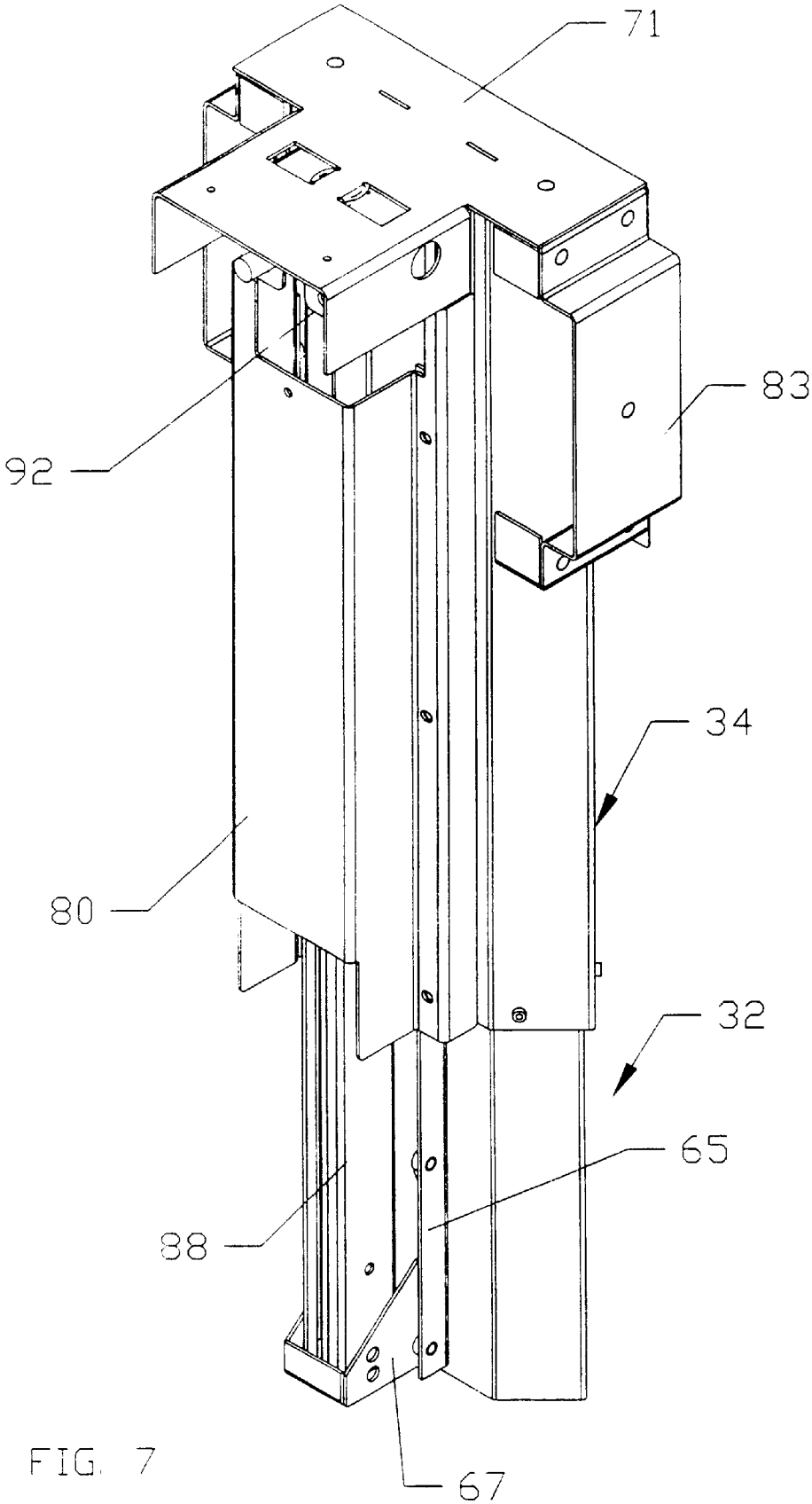
FIG. 7 is an isometric view of an adjustable leg assembly adapted for a hand crank adjustment for height.
Figure 8:
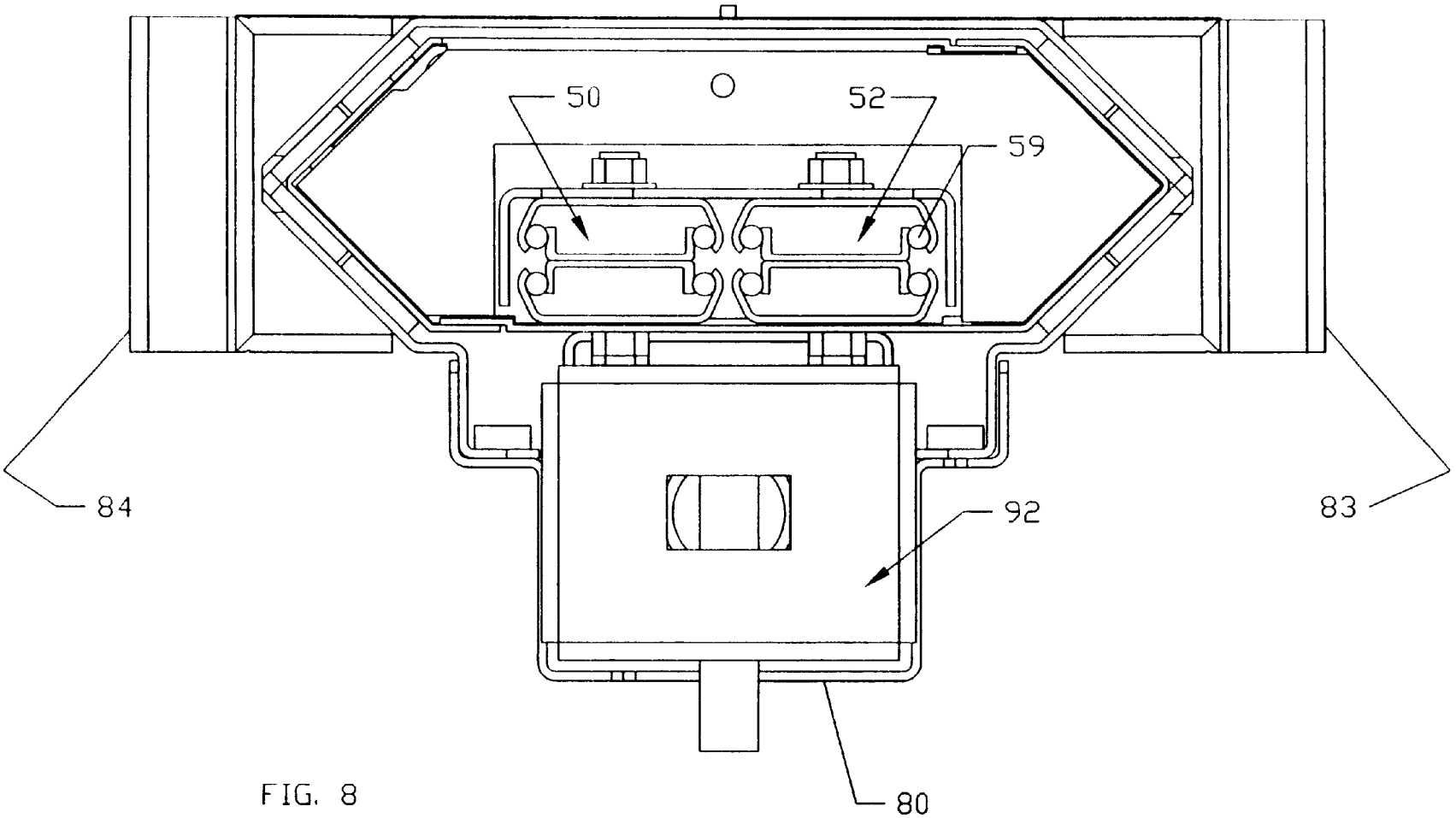
FIG. 8 is a plan view of the adjustable leg assembly of FIG. 7 with the cover plate removed.

Turning now to FIGS. 7 and 8, there are shown views, similar to FIGS. 5 and 6, for the hand-crank-assisted adjustable telescoping leg. The structure already described in connection with the inner telescoping leg 32 and outer telescoping leg 34, and the laterally aligned slides 50, 52, are the same as have been described above in connection with the motorized version of the telescoping leg. Therefore, similar elements bear the same reference numerals and will not be described further. In the hand crank leg, the crank structure is again conventional and well known to persons skilled in the art. Briefly, however, a rod having an acme thread is housed in the upright metal chamber 88, the bottom of the chamber being pinned to a bracket 89 mounted to the bottom of the channel 65, as with the motorized version (FIG. 5).

The drive shaft is free to rotate, being mounted in bearings at the top and bottom, and it is received in a internally threaded nut which is fixed and not permitted to turn. An input crank is attachable to a gear box such as that designated 92 in FIGS. 7 and 8. The gear box includes a bevel gear which turns the drive shaft in accordance with the direction in which the hand crank (not shown) is turned. The nut is fixed relative to the inner leg 32, and as the drive shaft is turned in one direction, its upper end is fixed to top plate 71 of the outer telescoping leg 34, thereby raising the outer telescoping leg relative to the inner telescoping leg, assisted and guided by the action of the slides 50, 52.

Figure 9:
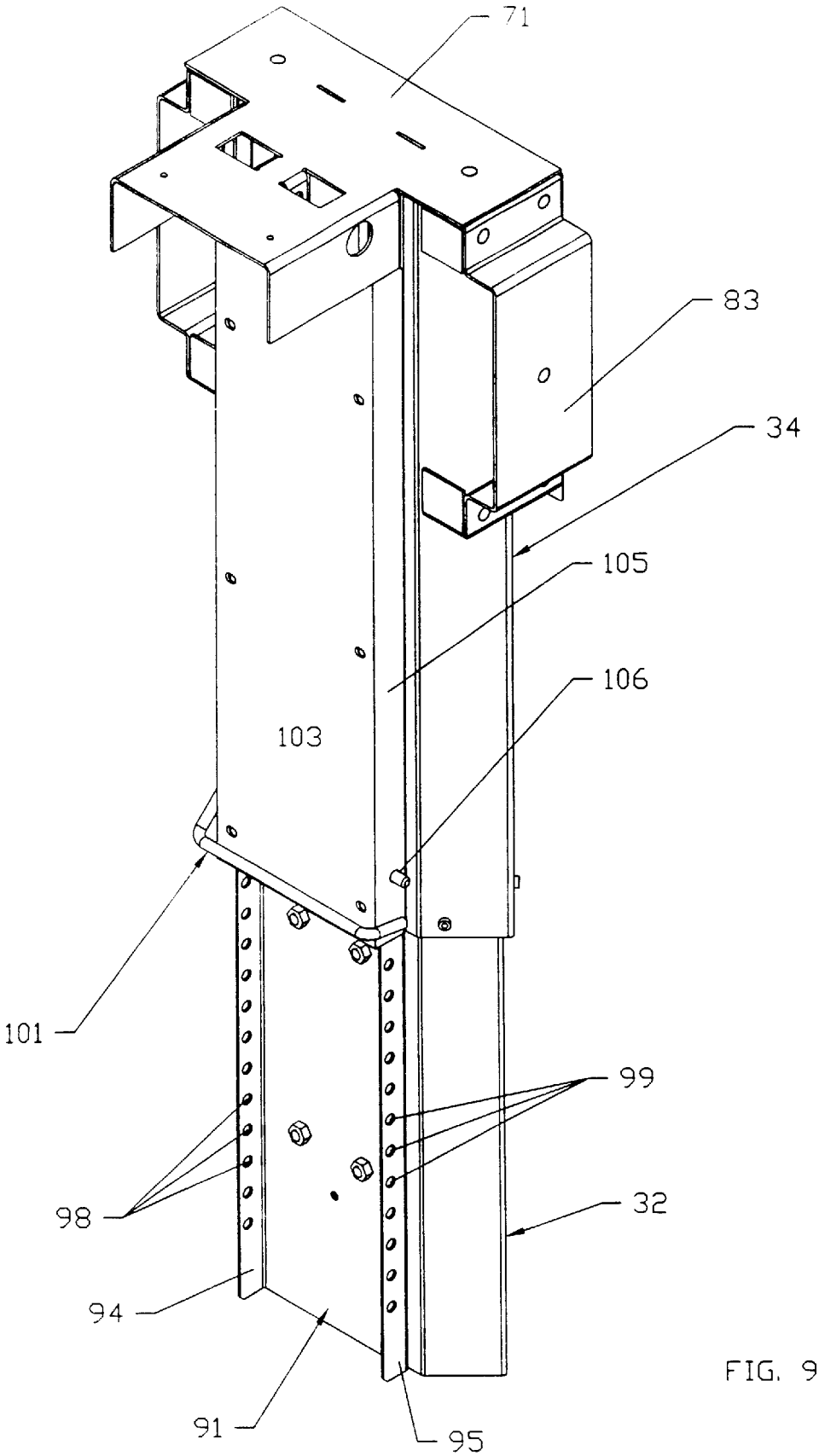
FIG. 9 is an isometric view of a telescoping leg assembly for the workstation of FIG. 2 which is adapted for manual slide adjustment.
Figure 10:
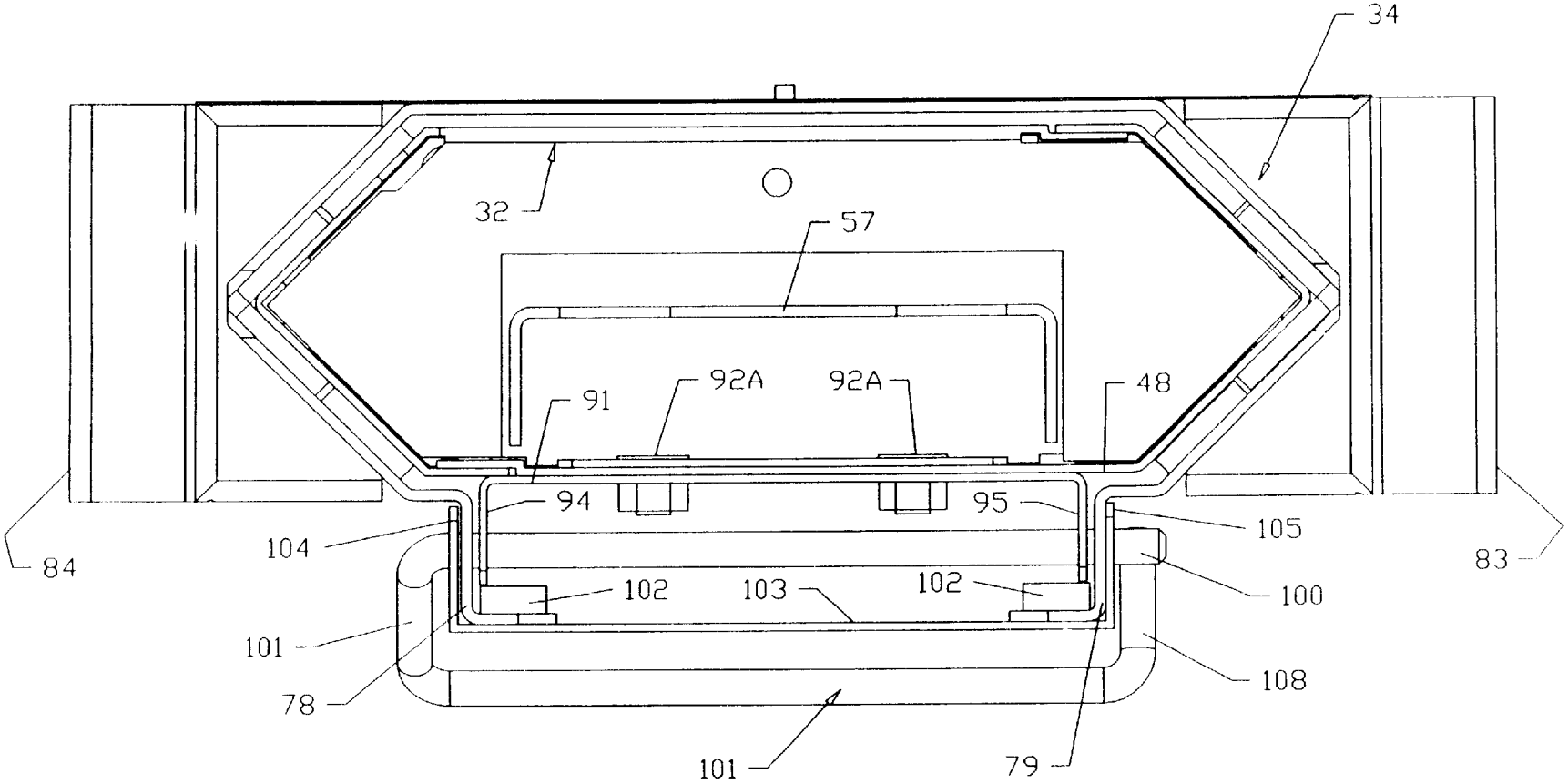
FIG. 10 is a top view of the leg assembly of FIG. 9.

Turning now to the embodiment of FIGS. 9 and 10, the manually adjustable slide leg is shown. Again, corresponding elements of the telescoping leg which have already been described and are carried over into the slide leg version, have been similarly identified by the same reference numerals in FIGS. 9 and 10 for the slide leg version, and the description need not be repeated here.

It will be observed from FIG. 10 that the internal channel 57 which is used to mount the first slide members 56 to the outer leg assembly is still present. However, the slides 50, 52 are not included in the slide leg version because adjustment is manual. Further, a channel 91 is secured by rivets, welds or studs such as those designated 92A to the plate 48 of the inner leg assembly 32. Channel 91 has flanges, designated 94, 95 respectively, as best seen in FIG. 9, which are provided with a series of vertically spaced apertures such as those designated 98 for the flange 94, and 99 for the flange 95. Each aperture on the flange 94 has a corresponding, horizontally aligned aperture on the flange 95 for receiving a lock member in the form of a formed rod generally designated 101. The lock 101 includes straight leg portion shown at 100 in FIG. 10 which fits into the apertures 98, 99 and aligned apertures on the outer leg 34, to be described, to lock the legs together.

Referring now to FIG. 9, the outer leg assembly 34 includes a cover plate 103 in the form of a channel, which is secured to weld nuts 102 (FIG. 10) respectively to the angled flanges 78, 79 of the outer telescoping leg 34. The channel member 103 includes flanges 104, 105, at the lower end of which are a pair of horizontally aligned apertures, one of which is designated 106 in FIG. 9, for receiving the straight leg 100 of lock member 101. Channel 91 of the inner, lower leg weldment is received in, and in opposing relation to, channel 103 of the outer leg weldment. The distal end of the straight portion 100 is bent to form another straight, shorter segment 108 which is spaced from the portion 100 by a section 107 to enable the lock member 100 to be rotated about the axis of the straight portion 100 so that the portion 108 clears the cover plate 103 and the straight portion 100 can be removed from the aligned apertures in the channel 91 of the inner leg and the channel 103 of the outer leg. This uncouples the two and permits the table and outer legs to be placed at a different elevation, and then coupled together again by means of the lock member 101.

Figure 11:
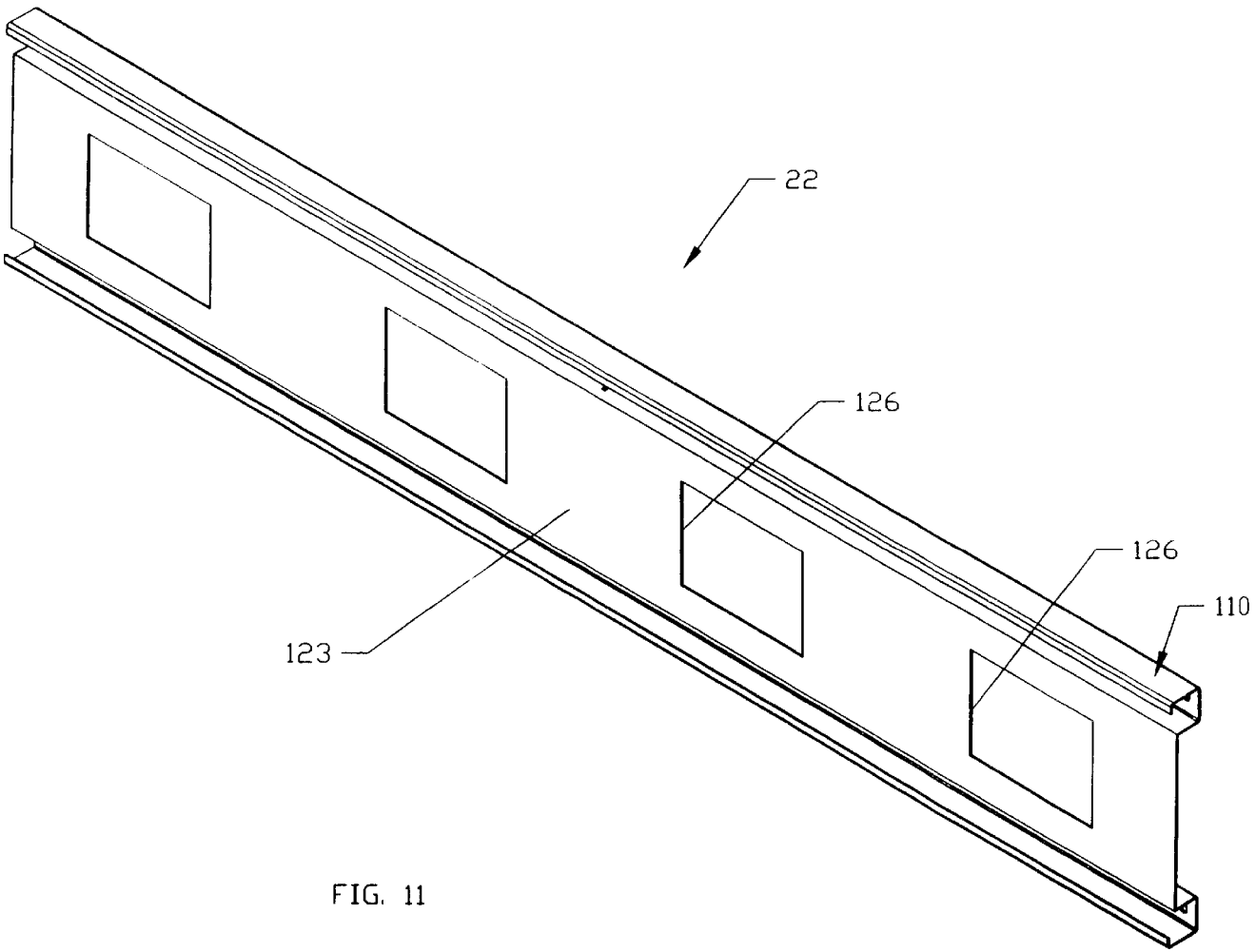
FIG. 11 is an isometric view, taken from the upper, rear, left side, of a fixing frame according to the present invention.
Figure 12:
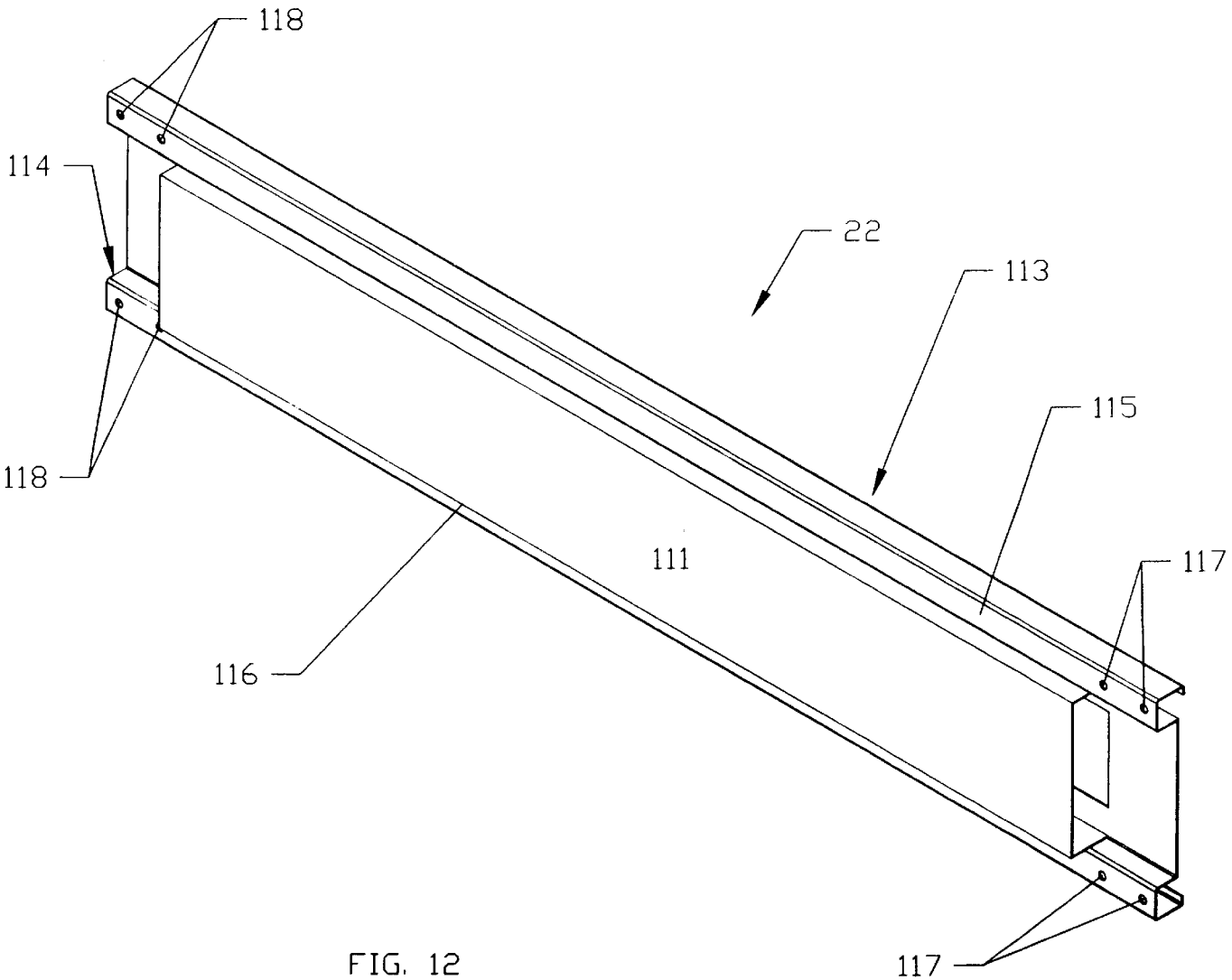
FIG. 12 is an isometric view taken from the upper, front side of the fixing frame of FIG. 11.
Figure 13:
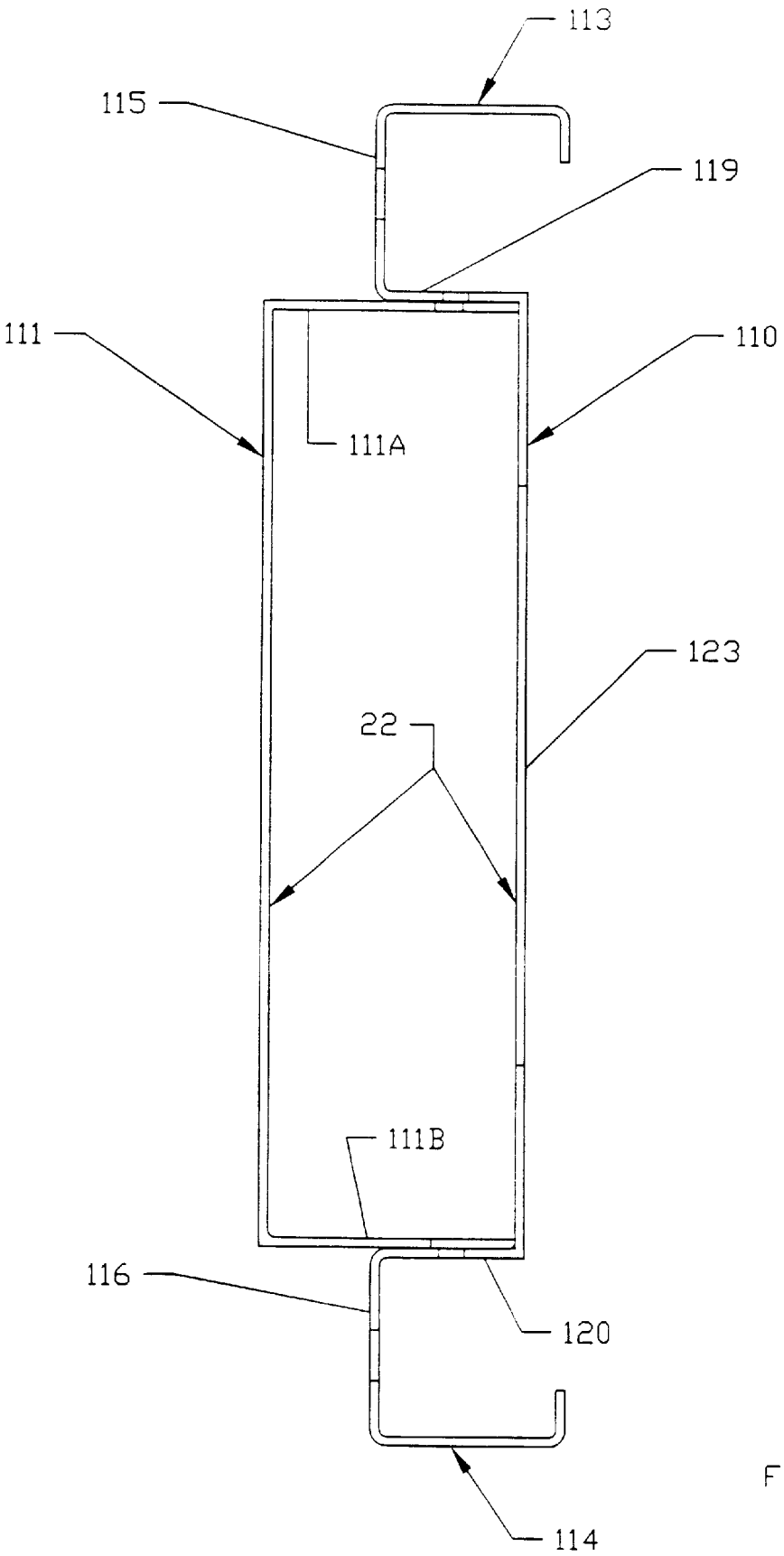
FIG. 13 is a right side elevation view of the fixing frame of FIG. 11.

Turning now to FIGS. 11, 12 and 13, there is shown in detail the fixing frame 22. The fixing frame 22 includes two primary members. The first is referred to as the connecting beam 110, and the second is referred to as a channel 111. The connecting beam is formed at top and bottom into generally rectangular, but incomplete chases generally designated 113 and 114 in FIG. 13. As seen in FIG. 12, the chases 113, 114 include vertical wall portions 115, 116, respectively, the ends of which are apertured at 117 and 118 respectively for receiving bolts which connect the fixing frame to the previously described brackets 83, 84 on the right and left telescoping legs, for all three versions of the workstation table.

The channel 111 has its flanges 111A, 111B (FIG. 13) turned in toward the connecting beam 110 and spot welded respectively to the lower surface of the wall 119 of the upper chase 113 and to wall 120 of the lower chase 114. Thus, the channel 111 and central web 123 of the connecting beam 110 form a box beam extended in the vertical direction, thereby substantially increasing the strength of the fixing frame and its ability to carry load and provide stability and rigidity to the main frame of the workstation. Moreover, the upper formed chase 113 and lower formed chase 114 provide respective continuous slots for mounting accessories or uprights or other utilities that may be used in connection with the workstation at any desired lateral setting.

Further, the main web 123 of the beam 110 is provided with rectangular slots such as those designated 126 in FIG. 11 for providing access into the conduit formed by the channel 111 and main web 123 of the connecting beam 110. The channel thus formed provides a chase or raceway for routing tubing, pneumatic hoses for power tools, and electrical wire or supplying power to electrical tools, meters or other devices. The apertures 126 provide convenient means to locate and route the contents of the conduit and to provide input and outlet apertures.

It will be observed from FIG. 12 that the length of the channel 111 is less than the length of the connecting beam 110, thus facilitating mounting of the fixing frame 22 to the brackets 83, 84.

We claim:

1. In a frame for an adjustable-height workstation including first and second upright leg assemblies, a floor-engaging support base for each leg assembly, and a generally horizontal fixing frame connected at first and second ends to said first and second leg assemblies respectively, the improvement comprising:

each upright leg assembly including an inner leg and an outer leg assembled in telescoping relation;

one of said inner leg and outer leg of each leg assembly connected to an associated end of said fixing frame and the other of said inner leg and outer leg of each leg assembly connected to an associated support base, each of said inner and outer legs comprising:

at least one side wall and first and second end walls extending respectively from a front and a rear of an associated side wall, said first and second end walls of said inner leg and said outer leg having first and second inclined walls formed in a general V shape and being nested with an adjacent end wall of the associated telescoping leg.

2. The apparatus of claim 1 wherein each leg assembly further comprises at least one slide assembly located within said telescoping legs and having a first slide member connected to said inner leg and a second slide member connected to said outer leg and arranged to strengthen the fore-to-aft stability of said leg assembly.

3. The apparatus of claim 1 characterized in that each of said leg assemblies is unhanded and interchangeable with another leg assembly.

4. The apparatus of claim 1 further comprising a plurality of pads of low friction material located between adjacent nested end walls of each leg to reduce friction between said inner and outer legs.

5. The apparatus of claim 1 further comprising a strut connected to the top of each leg assembly and extending toward a front side thereof for supporting a table top, and a stringer interconnected between forward ends of said struts.

6. The apparatus of claim 1 further comprising a linear actuator for each leg assembly and having a first end connected to said inner leg and a second end connected to said outer leg for powered height adjustment of said leg assemblies.

7. The apparatus of claim 1 further comprising a crank mechanism for each leg assembly, said crank mechanism including a screw fixed at a bottom to an associated inner leg and a drive gear carried by an associated outer leg and coupled to said screw to adjust the height of said outer leg when turned manually.

8. The apparatus of claim 1 wherein each of said leg assemblies further comprises;

a first channel fixed to an associated inner leg and having first and second upright flanges defining a plurality of vertically spaced pairs of horizontally aligned apertures;

a second channel connected to an associated outer leg of each leg assembly, and having first and second upright flanges, said second channel arranged in vertical sliding relation with an associated first channel and defining at least one pair of horizontally aligned apertures arranged to align with a selected pair of apertures of said first channel; and a lock member arranged to fit through aligned pairs of apertures of said first and second channels to fix said first and second leg assemblies at a predetermined height extension.

9. The apparatus of claim 1 wherein said fixing frame comprises a beam of sheet metal connected at one end to said first leg assembly and connected at another end to said second leg assembly, said fixing frame including a vertical wall; and a third channel fixed to said beam and cooperating therewith to form a box beam of closed cross section extending between said first and second leg assemblies.

10. The apparatus of claim 9 wherein said beam of said fixing frame includes a chase formed at one edge thereof and extending horizontally along said beam, said chase defining an elongated slot adapted to receive a fastener.

11. The apparatus of claim 9 wherein said beam includes a plurality of laterally spaced apertures permitting access to the interior of said box beam formed by said beam and said third channel.

12. In a frame for a workstation including first and second upright leg assemblies, a floor-engaging support base for each leg assembly, and a generally horizontal fixing frame connected at first and second ends to said first and second leg assemblies respectively, the improvement wherein said fixing frame comprises:

an elongated beam having an upright wall having an upper edge and a lower edge;

first and second chases formed respectively integrally with said upper edge and said lower edge of said upright wall and extending in a first lateral direction, each of said chases defining a laterally elongated slot opening for receiving fasteners; and a channel member fixed to said beam and including an upper horizontal flange and a lower horizontal flange fixed respectively to said first and second chases of said beam and cooperating with said beam to define a box beam, a width of said box beam extending in a vertical direction.

13. The apparatus of claim 12 wherein said vertical wall of said beam defines a plurality of laterally spaced openings providing access to the interior of said box beam whereby said box beam may act as a conduit for routing wire or tubing.

* * * * *